US010718221B2

(12) United States Patent
Rice

(10) Patent No.: US 10,718,221 B2
(45) Date of Patent: Jul. 21, 2020

(54) MORPHING VANE

(71) Applicant: Rolls Royce North American Technologies Inc., Indianapolis, IN (US)

(72) Inventor: Edward C. Rice, Indianapolis, IN (US)

(73) Assignee: ROLLS ROYCE NORTH AMERICAN TECHNOLOGIES INC., Indianapolis, IN (US)

( * ) Notice: Subject to any disclaimer, the term of this patent is extended or adjusted under 35 U.S.C. 154(b) by 965 days.

(21) Appl. No.: 14/837,302

(22) Filed: Aug. 27, 2015

(65) Prior Publication Data

US 2017/0058691 A1 Mar. 2, 2017

(51) Int. Cl.

*F01D 9/02* (2006.01)
*F01D 17/14* (2006.01)
*F01D 5/14* (2006.01)

(52) U.S. Cl.

CPC ..... *F01D 9/02* (2013.01); *F01D 5/146* (2013.01); *F01D 17/148* (2013.01); *F05D 2260/54* (2013.01); *F05D 2260/55* (2013.01)

(58) Field of Classification Search

CPC ..... F01D 9/02; F01D 17/14; F01D 17/148; F01D 17/16; F01D 17/162; F01D 5/146; F02C 9/20; F02C 9/22; F05D 2260/54; F05D 2260/55; B64C 15/00; B64C 15/02; B64C 15/14; B64C 29/0025; B64C 29/005; B64C 29/0066; B64C 3/50; B64C 9/02; B64C 9/28; B64D 33/04

USPC ..... 415/161; 416/23, 24

See application file for complete search history.

(56) References Cited

U.S. PATENT DOCUMENTS 2,388,208 A * 10/1945 Foss ..... F01D 17/162 123/41.58
2,716,460 A * 8/1955 Young ..... B64C 27/46 244/214
3,442,493 A 5/1969 Smith, Jr.
3,739,580 A 6/1973 Bland et al.
3,771,559 A * 11/1973 Alley ..... F16K 1/165 137/601.06
3,861,822 A 1/1975 Wanger
3,946,554 A 3/1976 Neumann
4,000,868 A 1/1977 Gregor
4,089,493 A 5/1978 Paulson
4,235,397 A 11/1980 Compton (Continued)

FOREIGN PATENT DOCUMENTS

GB 223292 A * 10/1924

*Primary Examiner* — Christopher Verdier
(74) *Attorney, Agent, or Firm* — Duane Morris LLP; Patrick Craig Muldoon; Paul H. Belnap

(57) ABSTRACT

A system for directing the flow of a fluid which comprises a channel for containing the fluid; an articulating vane positioned within the channel for directing the flow of the fluid, the vane comprising a fixed segment rigidly connected to the channel and a first moveable segment operably connected to the fixed segment by a first hub, the first hub configured to allow relative articulation between the segments; an actuator member operably connected to the moveable segment to articulate the moveable segment about the first hub; and wherein the vane further comprises a second moveable segment operably connected to the vane by a second hub, wherein the actuator member articulates the first and second moveable segments by applying a single moment to the first hubs.

8 Claims, 8 Drawing Sheets

(56) References Cited

U.S. PATENT DOCUMENTS

| | | | |
|---|---|---|---|
| 4,254,619 | A | 3/1981 | Giffin, III et al. |
| 4,705,452 | A | 11/1987 | Karadimas |
| 4,791,783 | A | 12/1988 | Neitzel |
| 5,180,119 | A | 1/1993 | Picard |
| 5,314,301 | A | 5/1994 | Knight |
| 5,464,175 | A | 11/1995 | Short |
| 5,472,314 | A | 12/1995 | Delonge et al. |
| 5,518,363 | A | 5/1996 | Theis |
| 5,520,511 | A | 5/1996 | Loudet et al. |
| 5,855,340 | A | 1/1999 | Bacon |
| 5,911,679 | A | 6/1999 | Farrell et al. |
| 5,947,412 | A | 9/1999 | Berman |
| 6,379,110 | B1 | 4/2002 | McCormick et al. |
| 6,845,606 | B2 | 1/2005 | Franchet et al. |
| 7,033,132 | B2 | 4/2006 | Gharib |
| 7,059,129 | B2 | 6/2006 | Zollinger et al. |
| 7,114,911 | B2 | 10/2006 | Martin et al. |
| 7,134,631 | B2 | 11/2006 | Loth |
| 7,140,188 | B2 | 11/2006 | Hosokawa et al. |
| 7,444,802 | B2 | 11/2008 | Parry |
| 7,464,533 | B2 | 12/2008 | Wollenweber |
| 7,491,030 | B1 | 2/2009 | Pinera et al. |
| 7,549,839 | B2 | 6/2009 | Carroll et al. |
| 7,631,483 | B2 | 12/2009 | Mani et al. |
| 7,665,689 | B2 | 2/2010 | McComb |
| 7,669,404 | B2 | 3/2010 | Samimy et al. |
| 7,828,516 | B2 | 11/2010 | Hartmann et al. |
| 7,837,436 | B2 | 11/2010 | Corsmeier et al. |
| 7,877,980 | B2 | 2/2011 | Johnson |
| 7,887,287 | B2 | 2/2011 | Yanagi et al. |
| 8,011,882 | B2 | 9/2011 | McMillan |
| 8,152,095 | B2 | 4/2012 | Cazals et al. |
| 8,161,728 | B2 | 4/2012 | Kupratis |
| 8,336,289 | B2 | 12/2012 | Roberge |
| 8,393,857 | B2 | 3/2013 | Copeland et al. |
| 8,468,795 | B2 | 6/2013 | Suciu et al. |
| 8,529,188 | B2 | 9/2013 | Winter |
| 8,578,700 | B2 | 11/2013 | Khakhar |
| 8,657,561 | B2 | 2/2014 | Buffone et al. |
| 8,770,921 | B2 | 7/2014 | Huber et al. |
| 8,813,907 | B2 | 8/2014 | Tanaka et al. |
| 8,862,362 | B2 | 10/2014 | Teicholz et al. |
| 8,915,703 | B2 | 12/2014 | Mohammed |
| 9,003,768 | B2 | 4/2015 | Suciu et al. |
| 9,016,041 | B2 | 4/2015 | Baughman et al. |
| 9,017,038 | B2 | 4/2015 | Pelley et al. |
| 9,563,203 | B2 * | 2/2017 | Davoodi ..... G05D 1/0088 |
| 9,957,823 | B2 * | 5/2018 | Epstein ..... F01D 9/041 |
| 2008/0131268 | A1 | 6/2008 | Guemmer |
| 2010/0166543 | A1 | 7/2010 | Carroll |
| 2011/0146289 | A1 | 6/2011 | Baughman |
| 2011/0167791 | A1 | 7/2011 | Johnson et al. |
| 2011/0167792 | A1 | 7/2011 | Johnson et al. |
| 2011/0167831 | A1 | 7/2011 | Johnson |
| 2011/0176913 | A1 | 7/2011 | Wassynger et al. |
| 2011/0252808 | A1 | 10/2011 | McKenney et al. |
| 2013/0122296 | A1 * | 5/2013 | Rose ..... E21B 23/14 428/376 |
| 2013/0323013 | A1 | 12/2013 | Mercier et al. |
| 2014/0090388 | A1 | 4/2014 | Hasel |
| 2014/0260180 | A1 | 9/2014 | Kupratis et al. |
| 2014/0345253 | A1 | 11/2014 | Dawson et al. |
| 2015/0102156 | A1 | 4/2015 | Devenyi |
| 2015/0121838 | A1 | 5/2015 | Suciu et al. |

* cited by examiner

MORPHING VANE

RELATED APPLICATIONS

This application is related to concurrently filed and co-pending applications U.S. patent application Ser. No. 14/837,190 entitled "Splayed Inlet Guide Vanes"; U.S. patent application Ser. No. 14/837,557 entitled "Propulsive Force Vectoring"; U.S. patent application Ser. No. 14/837,942 entitled "A System and Method for a Fluidic Barrier on the Low Pressure Side of a Fan Blade"; U.S. patent application Ser. No. 14/837,079 entitled "Integrated Aircraft Propulsion System"; U.S. patent application Ser. No. 14/837,987 entitled "A System and Method for a Fluidic Barrier from the Upstream Splitter"; U.S. patent application Ser. No. 14/837,031 entitled "Gas Turbine Engine Having Radially-Split Inlet Guide Vanes"; U.S. patent application Ser. No. 14/838,027 entitled "A System and Method for a Fluidic Barrier with Vortices from the Upstream Splitter"; U.S. patent application Ser. No. 14/838,067 entitled "A System and Method for Creating a Fluidic Barrier from the Leading Edge of a Fan Blade." The entirety of these applications are incorporated herein by reference.

FIELD OF THE DISCLOSURE

The present disclosure generally relates to systems used to control the direction of a fluid flow. More specifically, the present disclosure is directed to systems which use articulating vanes to control the direction of a fluid flow.

BACKGROUND

Many fluid systems use vanes to control the direction and flow rate of a fluid flow. Gas turbine engines are one example of such a fluid system. The typical gas turbine engine controls the direction of the air moving through engine with an array of vanes located in the inlet or outlet of the engine or in a duct internal to the engine. These vanes are typically unitary pieces which rotate about a single axis or consist of a fixed strut portion about which a variable vane, or flap, rotates. In some applications the vane may consist of two moveable portions which are connected and rotate about a common axis.

As these vanes are articulated, incongruences in the vane surface and discontinuities in the vane profile disrupts the air flow and reduce the pressure of the working fluid, thereby introducing inefficiencies in the fluid system. Some vanes attempt to mitigate these losses by incorporating flexible skins over the junctions between moving parts. Other vanes use deformable materials for the structural portions of the vane which form the contact surface with the working fluid.

The present application discloses one or more of the features recited in the appended claims and/or the following features which, alone or in any combination, may comprise patentable subject matter.

The present disclosure is directed to a system which addresses the deficiencies of traditional vane designs by increasing the number of moveable segments, and the number of pivot points around which the segments move, used in an articulating vane in order to lessen flow disruptions and pressure reductions of the working fluid, thereby introducing increasing the efficiency of in the fluid system According to an aspect of the present disclosure, a system for directing the flow of a fluid comprises a channel for containing the fluid; an articulating vane positioned within the channel for directing the flow of the fluid, the vane comprising a fixed segment rigidly connected to the channel and a first moveable segment operably connected to the fixed segment by a first hub, the first hub configured to allow relative articulation between the segments; an actuator member operably connected to the moveable segment to articulate the moveable segment about the first hub; and wherein the vane further comprises a second moveable segment operably connected to the vane by a second hub, wherein the actuator member articulates the first and second moveable segments by applying a single moment to the first hubs.

According to another aspect of the present disclosure, a system for directing the flow of a fluid comprises a channel for containing the fluid; an articulating vane positioned within the channel for directing the flow of the fluid, the vane comprising a fixed segment rigidly connected to the channel and a first moveable segment operably connected to the fixed segment by a first hub, the first hub configured to allow relative articulation between the segments; an actuator member operably connected to the moveable segment to articulate the moveable segment about the first hub; and wherein the vane further comprises a plurality of moveable segments operably connected to the vane by a plurality of hubs, wherein the actuator member articulates the moveable segments by applying a single moment to the first hubs.

According to another aspect of the present disclosure, a system for directing the flow of a fluid in a turbofan jet engine comprises a duct for containing the fluid; an articulating vane positioned within the duct for directing the flow of the fluid, the vane comprising a fixed segment rigidly connected to the duct and a first moveable segment operably connected to the fixed segment by a first hub, the first hub configured to allow relative articulation between the segments; an actuator member operably connected to the moveable segment to articulate the moveable segment about the first hub; and wherein the vane further comprises a plurality of moveable segments operably connected to the vane by a plurality of hubs, wherein the actuator member articulates the moveable segments by applying a single moment to the first hubs.

Figure 1A:
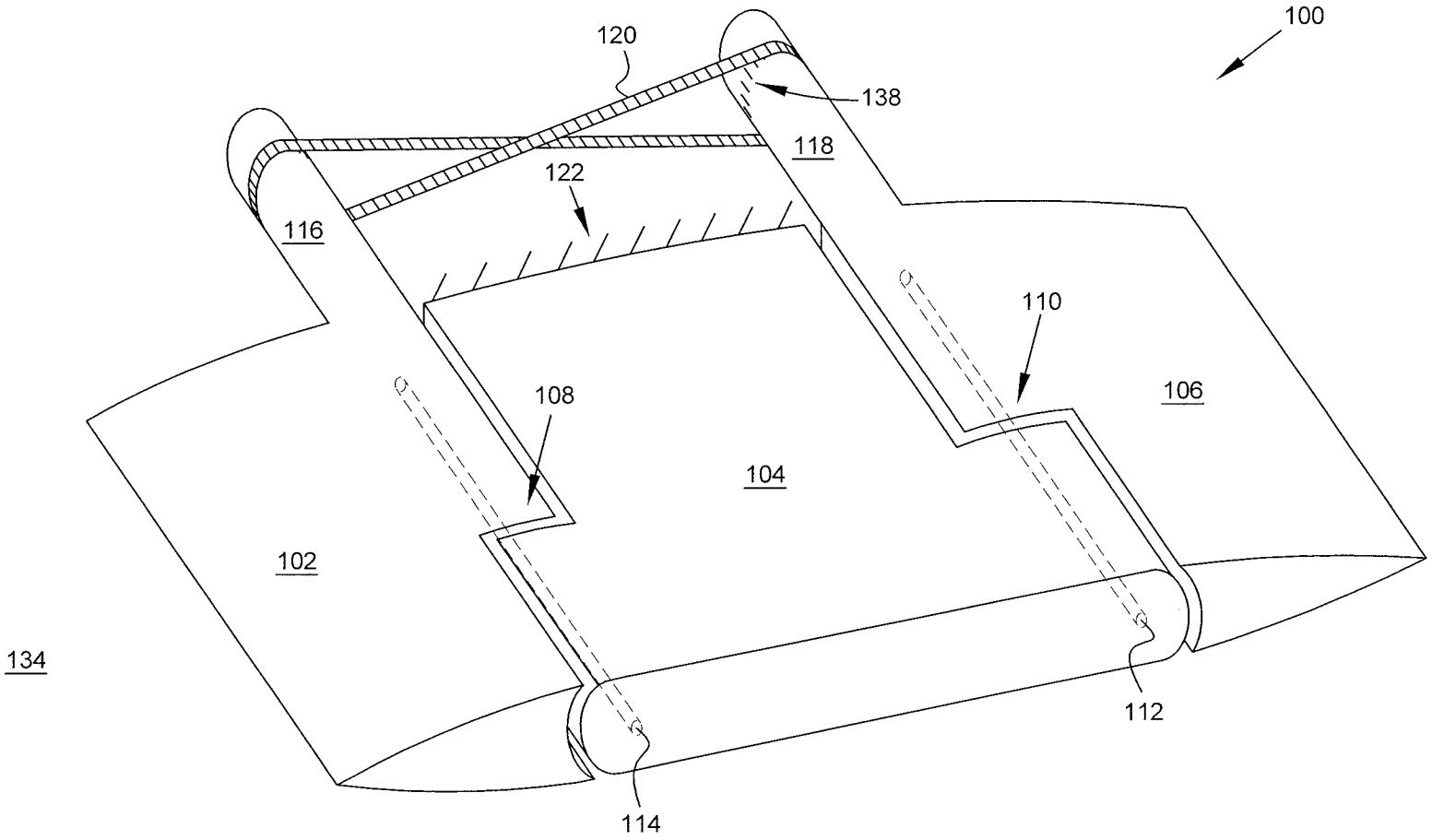
FIGS. 1A, 1B and 1C are illustrations representing a multi-segmented articulating vane in accordance with some embodiments of the present disclosure.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

For the purposes of promoting an understanding of the principles of the disclosure, reference will now be made to a number of illustrative embodiments illustrated in the drawings and specific language will be used to describe the same.

This disclosure presents numerous embodiments to overcome the aforementioned deficiencies of articulating vanes used in fluid system. More specifically, this disclosure is directed to multi-segmented vanes.

Figure 1B:
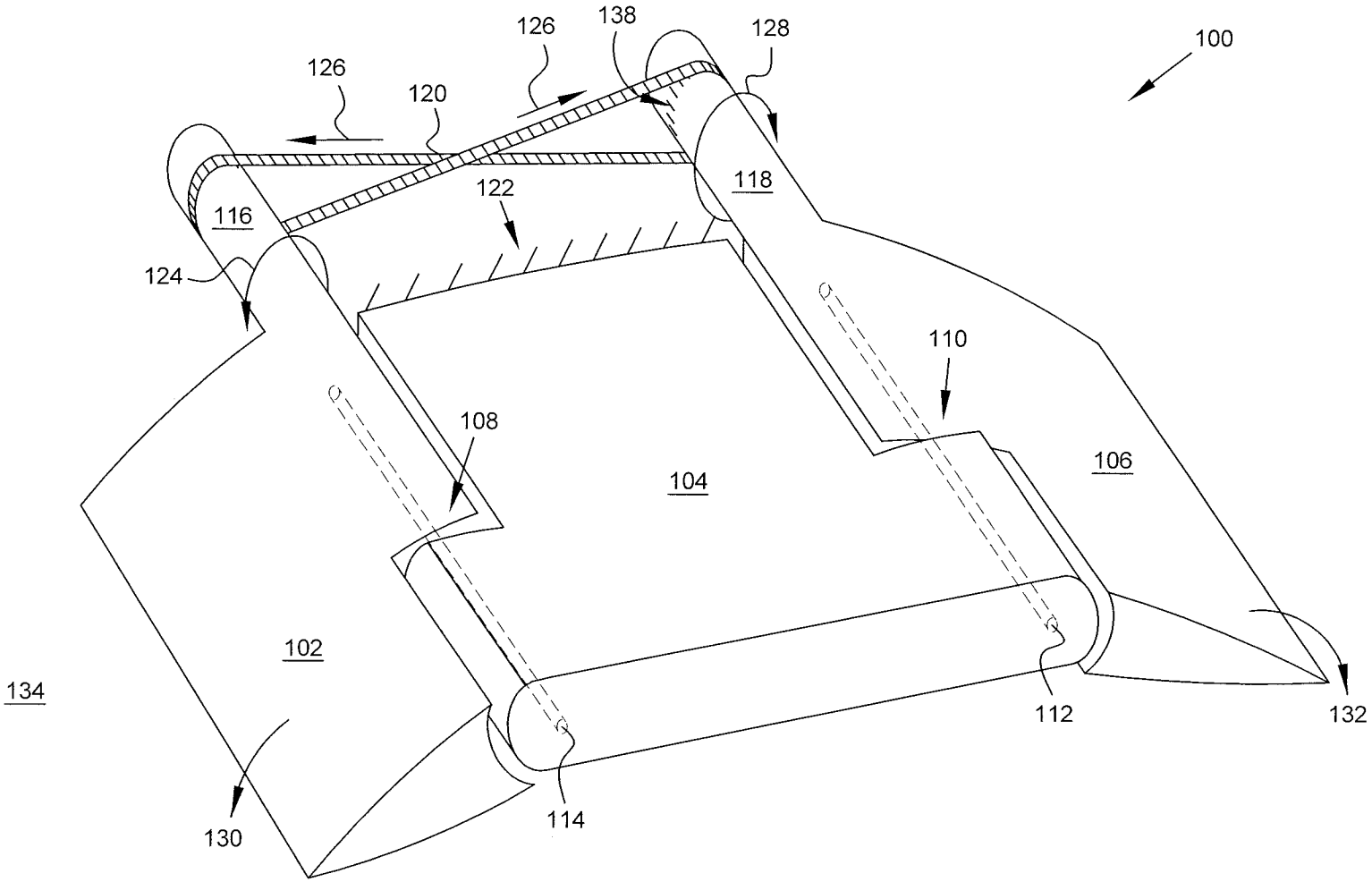
Figure 1C:
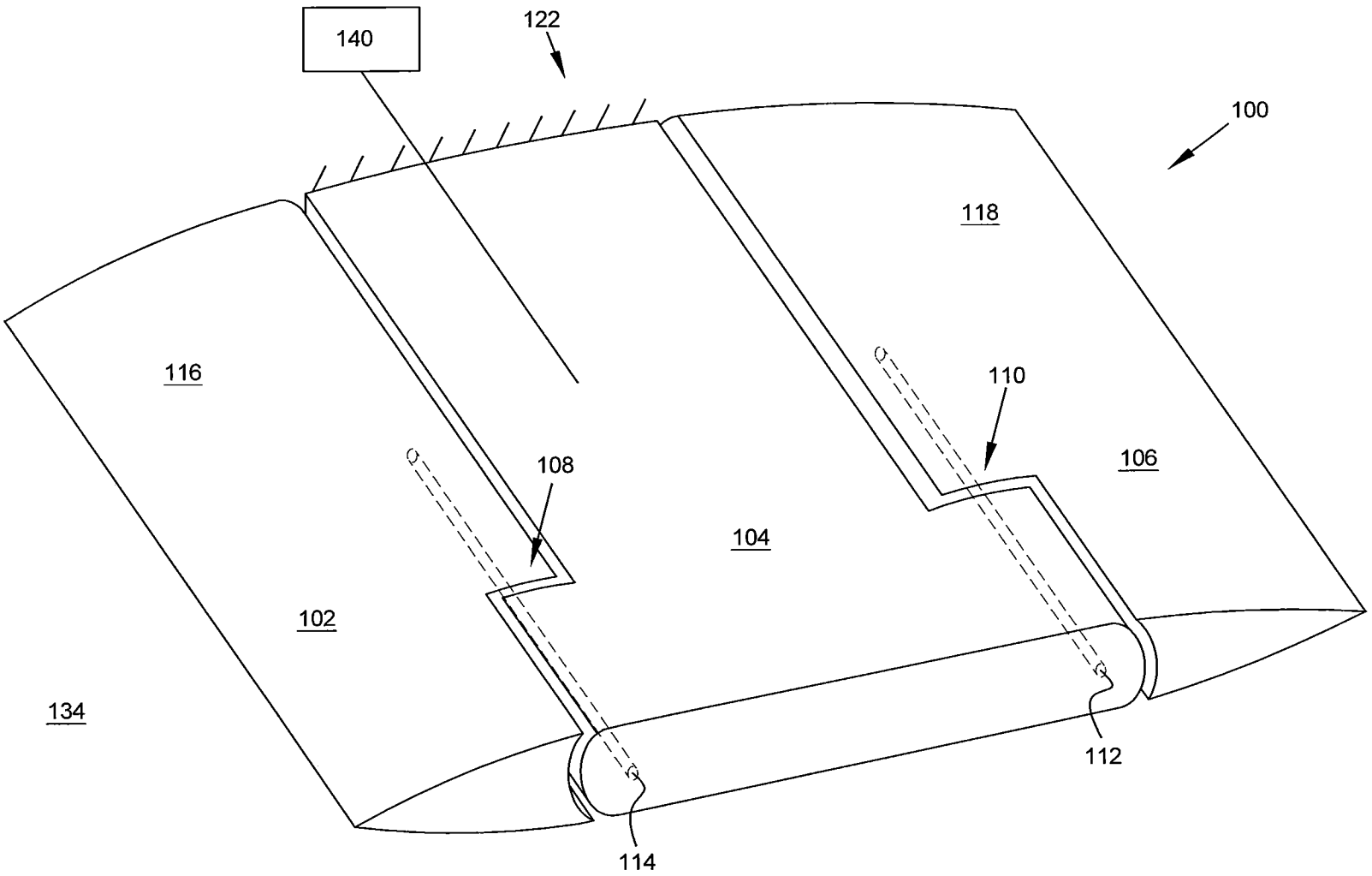

An illustrative multi-segmented vane 100 for directing the flow of a fluid is shown in FIGS. 1A and 1B. The vane 100 comprises segments 102, 104, and 106, hubs 108 and 110, pins 112 and 114, stem 116 and 118, and cable 120. Segments 102 and 106 are moveable vanes which are capable of articulating about hubs 108 and 110. Segment 104 is a fixed segment, as shown by 122, which does not move relative to the channel, duct, or structure 134 to which it is fixed. Hubs 108 and 110 may comprise the mating portions of segments 102/104 and 104/106, respectively. Pins 112 and 114 are disposed in a channel 134 passing through the hubs 110 and 108, respectively, to maintain the alignment of the segments 102, 104 and 106 about a common axis of the hubs during articulation of the moveable segments 102 and 106. The hub axis is collinear with the longitudinal axis of the pins. The stems 116 and 118 may protrude through a channel 134, duct, or structural wall (not shown) to which the vane 100 is attached.

The segments 102, 104 and 106 may comprise any segment profile as is required by the particular application. The segments 102, 104 and 106 may vary from one another in terms of length, width, or thickness or profile. As shown in FIGS. 1A and 1B, segments 102 and 106 comprise a portion of similar thickness to the thickness of segment 104 nearer their inner portion by hubs 108 and 110 and taper toward their outer leading and trailing edges, respectively. Any segment may also taper or expand toward its lateral edges. The gaps between the segments of vane 100 have been exaggerated to show the details of their mating surfaces.

The hubs 108 and 110 may comprise the mating junction of two segments as shown in FIGS. 1A and 1B. Other junctions may be used. For example, the portion of the fixed segment 104 partially forming hub 108 may by a single part centered between the lateral edges of the vane 100 surrounded on either lateral side by a portion of segment 102. In some embodiments, the fixed segment 102 may comprise the lateral portions of the hub 108 while segment 102 comprises a single portion laterally centered on the vane 100. Other designs are contemplated by the disclosure in which two segments can be joined such that at least one of the segments is capable of articulation relative to the other.

The stems 116 and 118 are used to couple the articulation of segments and may convert relative motion between segments into relative articulation. As shown in FIGS. 1A and 1B, stems 116 and 118 are comprised of elongated portions extending from segments 102 and 106, respectively, near an edge proximate to the fixed segment 104. These portions may extend through a wall of the channel, duct, or structure 134 to which the segment 104 is fixed and may be connected to an actuating mechanism. In some embodiments, the stems, or an equivalent structure, are located internal to the segments 102 and 104, in which case an articulating mechanism may protrude through the duct, channel 134, or structural wall to operably engage a segment or stem.

Disposed on the stems 116 and 118 may be a set of teeth or gears 138 used to operably engage a chain or belt coupling stems 116 and 118. The stems may also be smooth along their entire length. The cable 120 comprise carbon fiber or carbon nano-tube threads. The cable 120 may be replaced by solid link ties, belt(s), or other methods which similarly couple the motion of stems 116 and 118. The cable 120 may be located internal to segments 102 and 104 and pass through an internal cavity 140 in segment 104.

In some embodiments, each stem 116 and 118 may comprise a structure of a radius different from that of the other stem. Using stems 116 and 118 with different radii allow the variation in rates of articulation of each stem and segment. This also allows the articulation of each segment to be individually tuned such that a more precise and complex vane profile can be achieved.

As shown in FIG. 1B, applying a single moment to one of the stems 116 or 118 results in the articulation of both moveable segments 102 and 104. A single moment 124 may be applied to the applied to the stem 116 by an actuating mechanism (not shown). This moment 124 will articulate the stem 116, causing both the downward movement of segment 102, as shown by 130, as well as the counterclockwise rotation of stem 116 about the axis of hub 108. As the stem 116 rotates, the gears or teeth 138 will rotate and engage cable 120 causing the cable to move as indicated by arrows 126. The cable 120 will then engage the gears or teeth 138 on stem 118, translating the linear motion of the cable 120 into the clockwise rotation motion 128 of the stem 118 about the axis of the hub 110, articulating the segment 106 downward as shown by 132. In some embodiments, friction between the cable 120 and the stems may translate the linear motion to rotational motion. The clockwise rotation of stem 118 is effectuated by the figure eight use of the cable 120 between stems 116 and 118.

Figure 2:
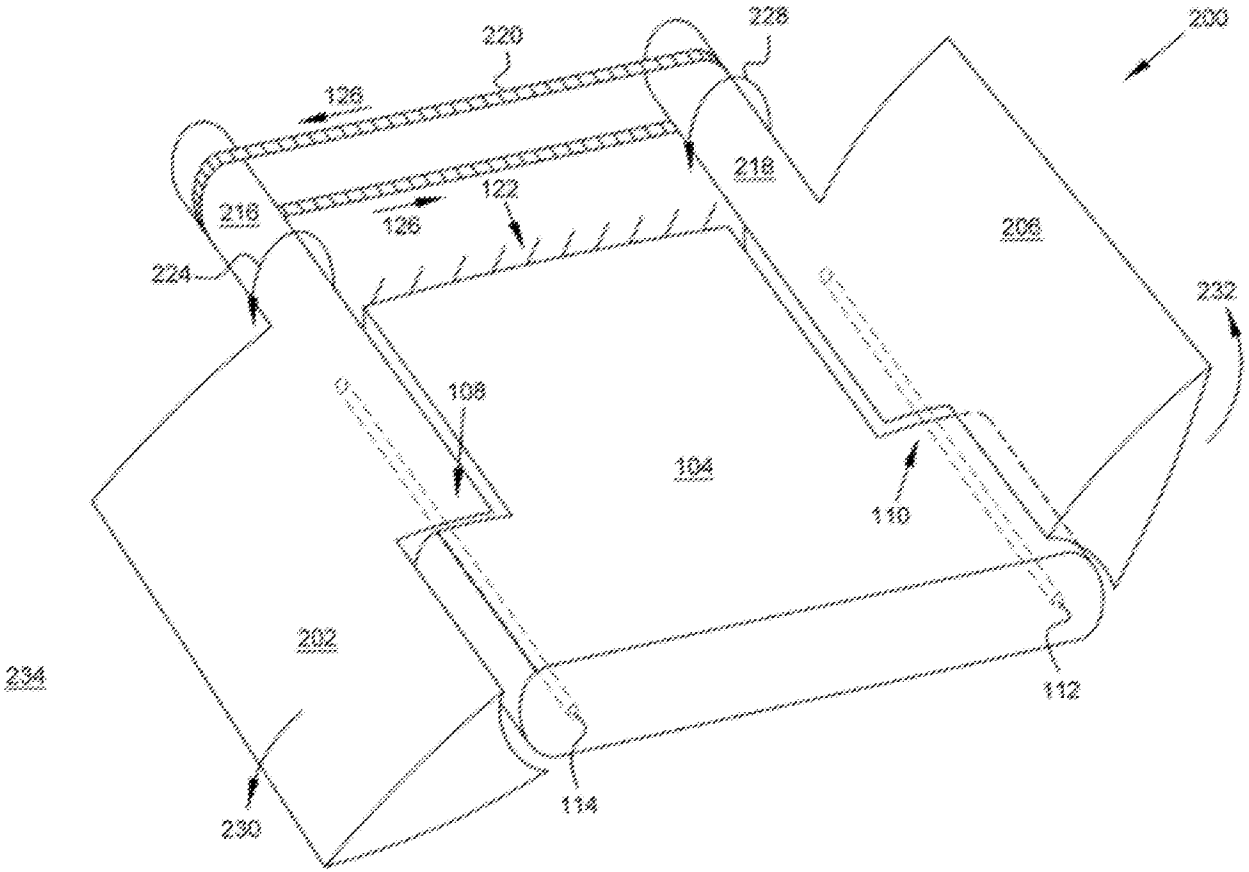
FIG. 2 is an illustration representing a multi-segmented articulating vane in accordance with some embodiments of the present disclosure.

An embodiment of a multi-segmented vane 200 for directing the flow of a fluid is illustrated in FIG. 2. In this embodiment, the cable 220 is connected such that the longitudinal length of the cable runs are parallel with one another between stems 216 and 218. Here, a moment 224 is applied to stem 216 which causes the stem 216 to rotate counterclockwise, thereby articulating segment 202 downward, as indicated by arrow 230, driving the movement of cable 220. In turn, the linear motion of cable 220 will be translated into the counterclockwise rotational motion 228 of stem 218. Finally, segment 206 is articulated upward as indicated by arrow 232.

Figure 3A:
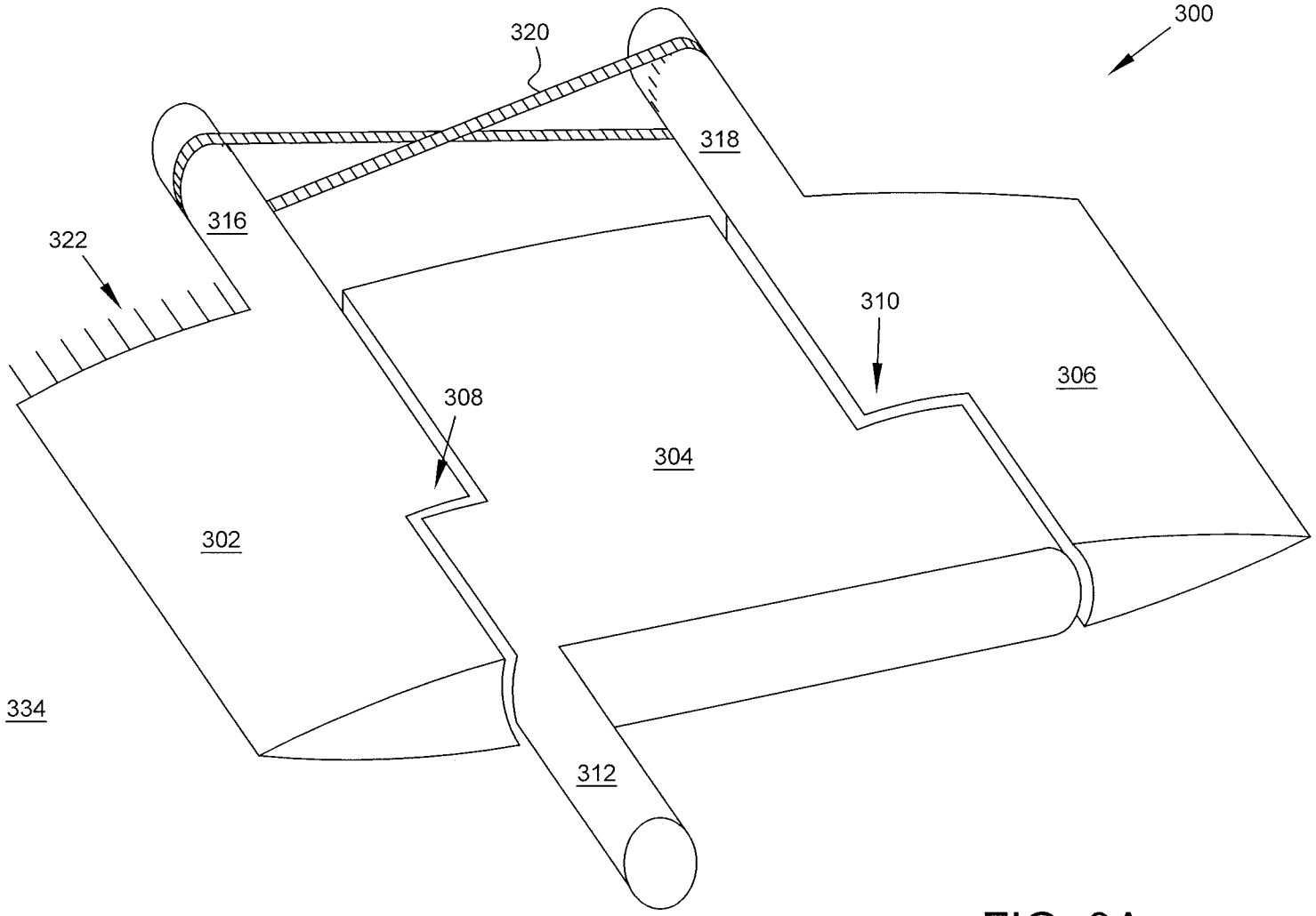
FIGS. 3A and 3B are illustrations representing a multi-segmented articulating vane in which the leading segment is fixed in accordance with some embodiments of the present disclosure.

In some embodiments, a segment other than a middle, internal, or non-leading or -trailing segment may be fixed to the channel, duct or structure 234/334 which supports the vane. FIG. 3A illustrates an embodiments of a multi-segmented vane 300 in which the a leading vane 302 is fixed as shown by 322. The multi-segmented vane 300 comprises a fixed segment 302, moveable segments 304 and 306, hubs 308 and 310, pins (not shown) connecting the respective segments about the hubs 308 and 310, stems 316 and 318, cable 320 and stem 312. The stem 312 is rigidly connected to moveable segment 304 and stem 316 is rigidly connected to the fixed segment 302 and the moveable segment 306 is rigidly connected to stem 318. While the stem 312 is connected to the vane 300 on the lateral side opposite that of stems 316 and 318, the stems may be located on the same lateral side of the vane 300. Additionally, equivalent functioning structures may be located internally to the segments 302, 304 and 306. Stem 312 is operably connected to an actuating mechanism (not shown), and stems 316 and 318 are operably coupled to translate the relative motion between segments 302 and 306 (or, hub 310) into an articulating motion. Each stem 312, 316 and 318 may be located at any point along the longitudinal length of segments 304, 302 and 306, respectively.

Figure 3B:
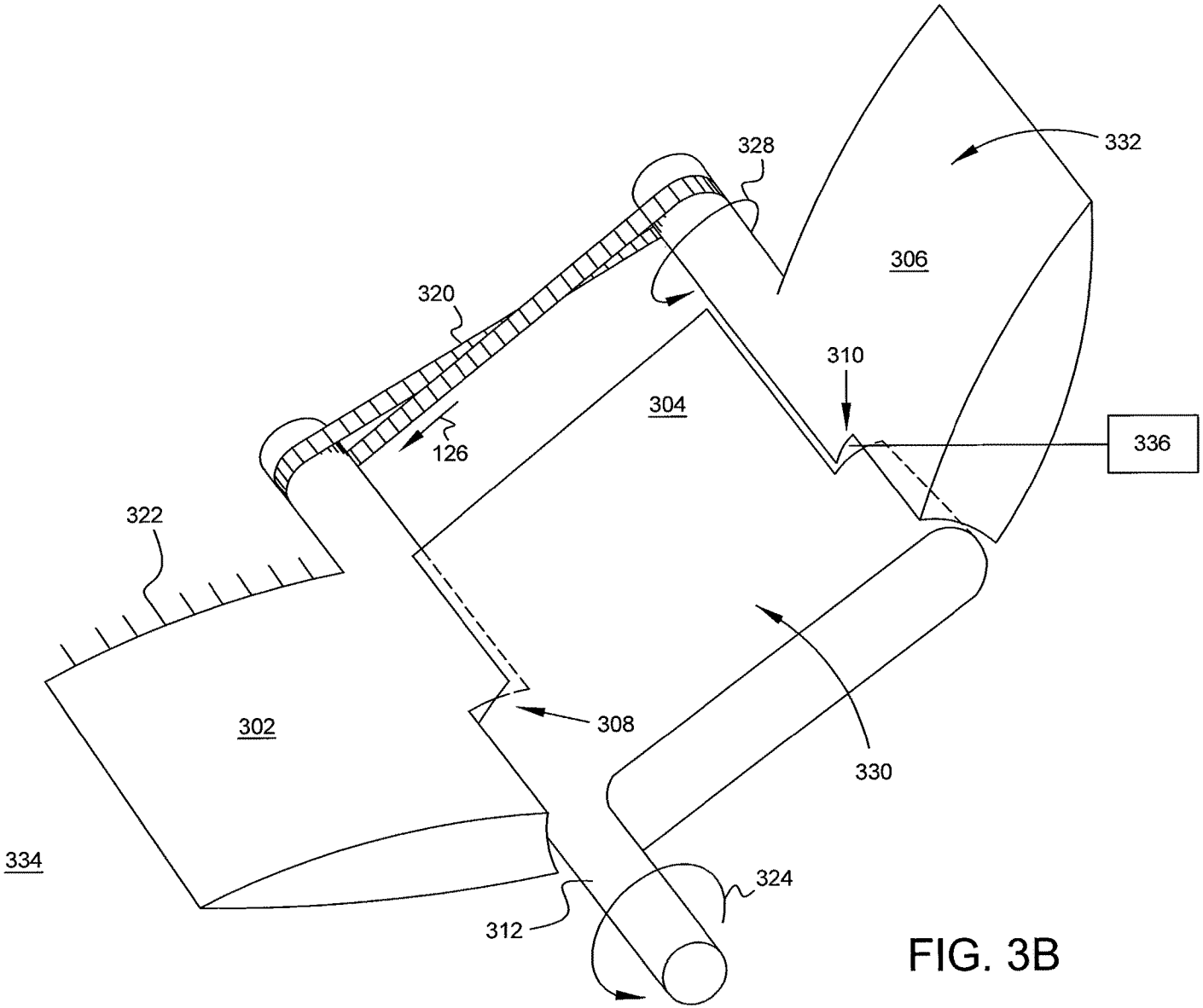

As shown in FIG. 3B, applying a single moment to the stem 312 results in the articulation of both moveable segments 304 and 306. A single moment 324 may be applied to the applied to stem 312 by an actuating mechanism (not shown). This moment 324 will articulate the stem 312, causing the upward movement of segment 304, as shown by 330. As the segment 304 articulates, relative motion is driven between hub 310 and the fixed segment 302, or stems 316 and 318. This relative motion places a tension on the cable 320 which causes a moment 328 to rotate stem 318, thereby articulating segment 306 upward, as indicated by 332.

In some embodiments, the cable 320 may be rigidly fixed to stems 316 and 318. The cable may comprise two separate segments which may wrap fully, partially or more than once around the stems in directions opposite from one another. In some embodiments hub 310 further comprises a restoring spring 336 which deflects from its neutral position when there is relative motion between segments 304 and 306. This deflection will introduce a force to drive the realignment of segment 306 with segment 304 when the actuator returns segment 304 to the position as shown in FIG. 3A. This spring may be an angular spring in which one end of the spring is rigidly fixed to segment 306 and the other end is rigidly fixed to segment 304.

In some embodiments, the stem 318 may be operably connected to an arcuate gear track mounted to the wall of the channel, duct or structure 334 to which the vane 300 is attached. The stem 318 may comprise gear teeth that operably engage the gear track. The movement of segment 304 drives hub 310 (and stem 318) along the gear track, thereby creating relative motion between the stem 318 and gear track and articulating segment 306.

In some embodiments, the cable 320 may be operable connected to stem 318 and fixed to the wall. The cable 320 may wrap around the stem 316 partially, fully, or more than once. An internal tensioning mechanism contained in the stem 318 functions to maintain tension in the cable 320 such that it will rewrap around the stem 318 when the vane 300 returns to its normal position. From its normal position, movement of the hub 310 will cause tension in the cable 320 because one end of the cable is fixed to the wall and the other wrapped around the moving stem 318 connected to hub 310. This tension will be relieved by the rotation of the stem 318 thereby unwinding as the cable 320. The direction of rotation of stem 318 can be controlled by wrapping the cable 320 around the stein 318 in a clockwise or counterclockwise fashion.

Figure 4:
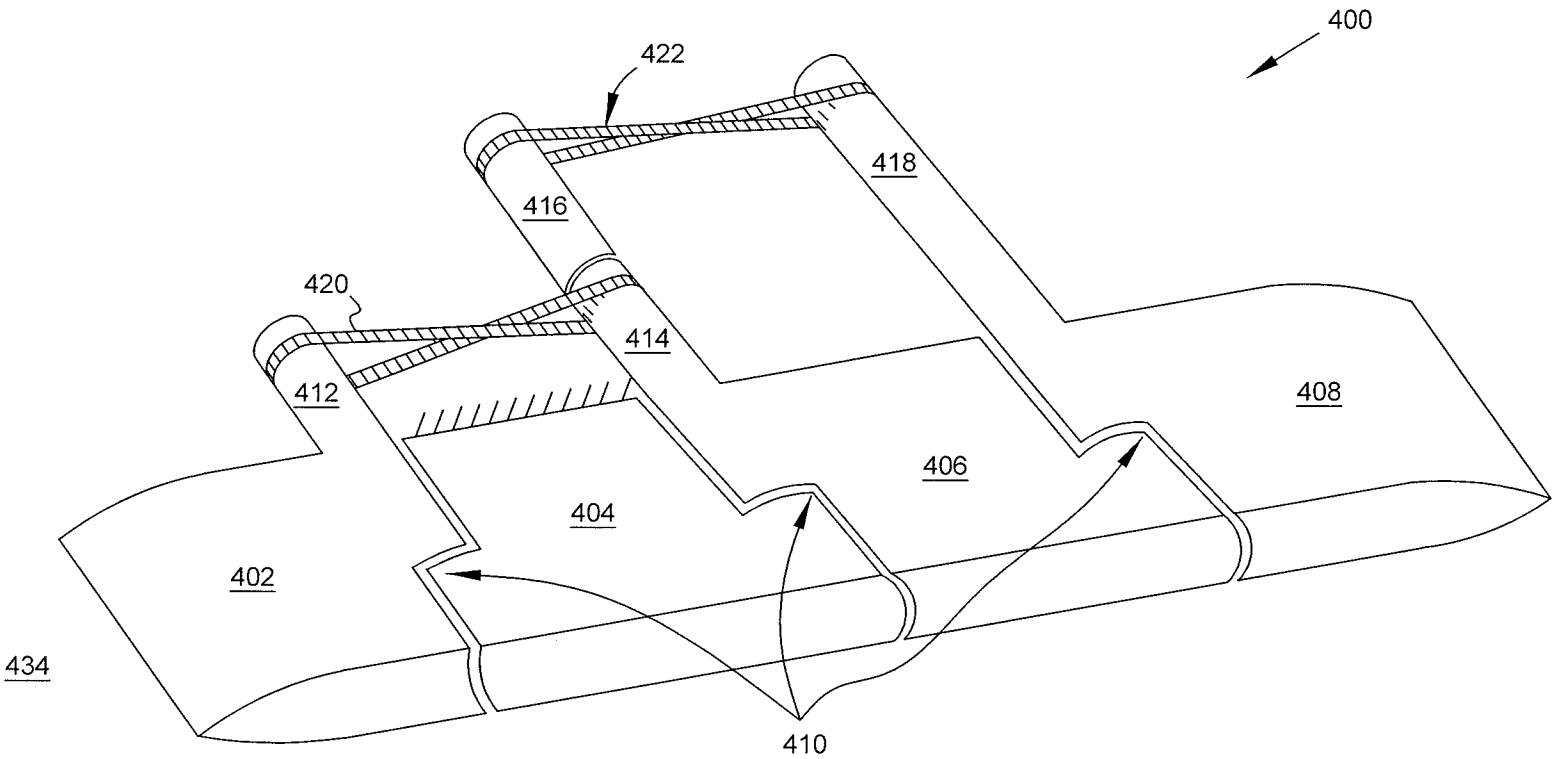
FIGS. 4 and 5 are illustrations representing a multi-segmented articulating vane in accordance with some embodiments of the present disclosure.

An illustrative example of a multi-segmented vane 400 is disclosed in FIG. 4. The vane 400 comprises segments 402, 404, 406 and 408, hubs 410, stems 412, 414, 416 and 418, cables and 420 and 422. Vane 404 is rigidly fixed to the channel 434, duct or structural wall (not shown). The segments are connected by pivoting hubs 410 which contain aligning pins (not shown). The stems 412, 414, 416 and/or 418 may protrude through the channel 434, duct or structural wall or may be located within segments 402, 404, 406 or 408. Stem 416 is rigidly connected to segment 404, in some embodiments by a connecting rod (not shown) which passes through stem 414. The cables 420 and/or 422 may be located within the segments.

A single moment may be applied by an articulating mechanism (not shown) to either stems 412 or 414 which articulates segments 402 and 406 as described above. This will drive relative motion between operation stem 418 and 416 because the hub 410 between segments 406 and 408 is driven by the articulation of segment 406. The relative motion will lead to the articulation of segment 408 as described above. Alternatively, stem 418 may be operably connected to fixed point or structure in order to effectuate the rotation of stem 418.

Figure 5:
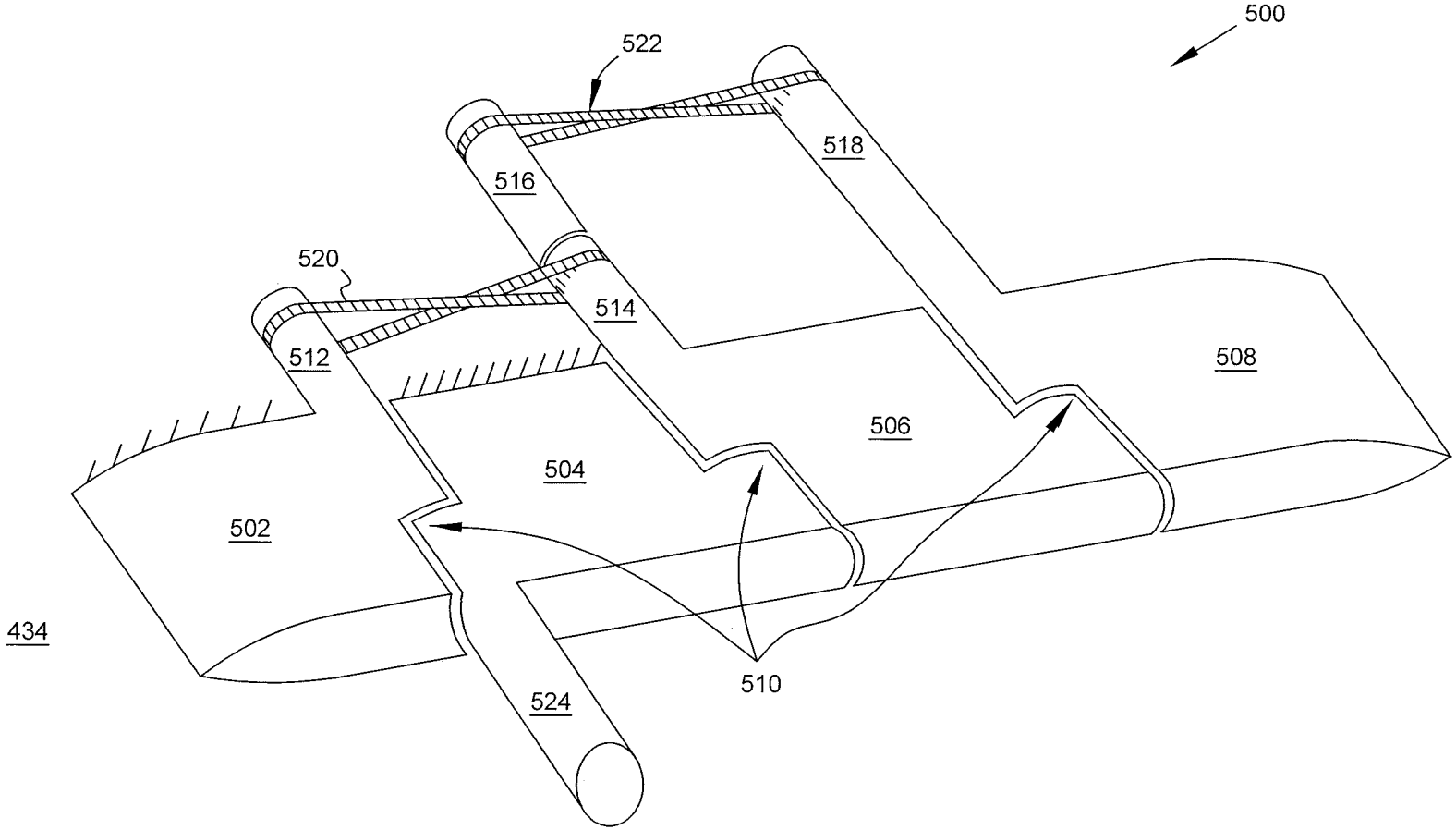

FIG. 5 illustrates an embodiment of a multi-segmented vane 500. The vane comprises segments 502, 504, 506 and 508, hubs 510, stems 512, 514, 516, 518, and 524 and cables 520 and 522. Segment 502 is rigidly fixed to a channel 534 duct or structural wall. Segments 504, 506 and 508 are free to articulate.

A single moment may be applied by an articulating mechanism to stem 524 to articulate segment 504, 506 and 508. This movement will drive relative motion between stems 514 and 512. Stem 512 is connected to segment 502 and is therefore fixed. This relative motion will articulate segment 506, which in turn drives relative motion between segments 508 and 504. This second relative motion also drives relative motion between stems 518 and 516 (which are fixed to segments 508 and 504, respectively), causing tension in cable 522 which will rotate stem 518 and articulate segment 508. In some embodiments stem 516 is rigidly fixed to segment 504 by a connection rod (not shown) which passes through stem 514. In some embodiments the stems 514 and 518 may be operably connected to a fixed point or structure on the channel 534, duct or structural wall in order to effectuate rotation of segments 506 and 508.

The disclosure contemplates fixing any segment of the multi-segmented vane while affecting the articulation of a plurality of moveable segments by applying a single moment. Increases in the number of segments and pivot hubs allows the design of more gradual and/or controlled changes in the profile of a vane. These smoother profiles will lead to the redirection of an airflow with minimal disruption to the flow and lower pressure losses than with other vane systems.

While preferred embodiments of the present invention have been described, it is to be understood that the embodiments described are illustrative only and that the scope of the invention is to be defined solely by the appended claims when accorded a full range of equivalence, many variations and modifications naturally occurring to those of skill in the art from a perusal hereof.

I claim:

1. A system for directing a flow of a fluid comprising:

a channel for containing the fluid;

an articulating vane disposed in said channel, said articulating vane comprising:

a fixed segment rigidly coupled to said channel;

a first moveable segment comprising a first stem rotatably coupled to said fixed segment via a first hub;

a second moveable segment comprising a second stem rotatably coupled to said fixed segment via a second hub; and a cable in contact with both of said first and second stems, said cable having a fixed length; and an actuator connected to said first stem, wherein said actuator applies a first moment to said first stem causing said first moveable segment to rotate about the first hub, said rotation of said first moveable segment imparts a force from said first stem to said cable causing said cable to move, and said movement of said cable applies a second moment to said second stem causing said second moveable segment to rotate about the second hub.

2. The system of claim 1, wherein said second hub is operably connected to said fixed segment.

3. The system of claim 1, wherein said second hub is operably connected to said first moveable segment and coupled to said vane such that the first moment applied to said first stem causes relative motion between said second hub and said fixed segment in order to affect articulation of said second moveable segment relative to said first moveable segment.

4. The system of claim 1, wherein said second hub further comprising a restoring element to return said second moveable segment to an original position upon the removal of the first moment from said first stem.

5. The system of claim 4, wherein said cable comprises nano-carbon fibers.

6. The system of claim 1, wherein said second moveable segment is operably coupled to said vane outside of said channel.

7. The system of claim 1, wherein said second moveable segment is operably coupled to said vane via a pathway internal to said vane.

8. The system of claim 1, wherein only one of the said first or second moveable segments leads said fixed segment in said channel relative to the direction of the fluid flow.

* * * * *